US006902333B2

(12) United States Patent
Miyagawa et al.

(10) Patent No.: US 6,902,333 B2
(45) Date of Patent: Jun. 7, 2005

(54) CONTAINER CAPABLE OF MOVING A CONTAINED ARTICLE IN LONGITUDINAL DIRECTION

(75) Inventors: Koji Miyagawa, Higashiosaka (JP); Toshiki Kurumada, Osaka (JP)

(73) Assignees: M·F·V Co., Ltd., Higashiosaka (JP); Rohto Pharmaceutical Co., Ltd., Osaka (JP)

( * ) Notice: Subject to any disclaimer, the term of this patent is extended or adjusted under 35 U.S.C. 154(b) by 308 days.

(21) Appl. No.: 10/174,967

(22) Filed: Jun. 20, 2002

(65) Prior Publication Data

US 2002/0197093 A1 Dec. 26, 2002

(30) Foreign Application Priority Data

Jun. 22, 2001 (JP) ..... 2001-189968
Jun. 22, 2001 (JP) ..... 2001-189969

(51) Int. Cl.[7] ..... B43K 21/18
(52) U.S. Cl. ..... 401/66; 401/87; 401/181
(58) Field of Search ..... 132/317, 318, 132/320; 401/66, 82, 83, 87, 181; 222/192

(56) References Cited

U.S. PATENT DOCUMENTS 1,948,074 A * 2/1934 Matheret et al. ..... 401/59
1,955,295 A * 4/1934 Hickox ..... 401/59
2,043,250 A * 6/1936 Kasdan et al. ..... 401/84
2,402,072 A * 6/1946 Nehrke ..... 401/60
2,453,250 A * 11/1948 Nehrke ..... 401/60
3,810,700 A * 5/1974 Bryan ..... 401/59
3,934,598 A * 1/1976 Hayes et al. ..... 401/59
3,941,489 A * 3/1976 Bryan ..... 401/59
3,954,114 A * 5/1976 Ostrowsky et al. ..... 401/59
4,367,965 A * 1/1983 Speitel et al. ..... 401/60
4,917,273 A * 4/1990 Seager ..... 222/392
5,984,551 A * 11/1999 Kinney, Jr. ..... 401/59
6,237,613 B1 * 5/2001 Finnigan ..... 132/318
6,718,990 B1 * 4/2004 Neu et al. ..... 132/218

FOREIGN PATENT DOCUMENTS

JP 58-112214 U 8/1983
JP 8-126525 A 5/1996
JP 11-164730 A 6/1999

* cited by examiner

*Primary Examiner*—Kevin Shaver
*Assistant Examiner*—Stephanie L. Willatt
(74) *Attorney, Agent, or Firm*—Smith Patent Office

(57) ABSTRACT

A main body of a container for a prepared article is comprised of a housing, an inner frame member, an operative member and an operating knob. The inner frame member is provided with a guiding projection at its lower part, and the operative member is provided with a holder for the prepared article at one end thereof. The operative member is inserted into the inner frame member, is drawn out at the bottom of the inner frame member with the holder left inside the inner frame member, and is folded in U-shaped along the guiding projection. In this state, the operative member is inserted together with the inner frame member into the housing through an opening at the leading end of the housing. The operative member is assembled into the housing in this way. The operating knob is mounted on the operative member via a slit from the outside of the housing.

24 Claims, 13 Drawing Sheets

CONTAINER CAPABLE OF MOVING A CONTAINED ARTICLE IN LONGITUDINAL DIRECTION

BACKGROUND OF THE INVENTION

This invention relates to a container for containing a prepared article such as a lipstick, a medical lip balm or a paste or a fixed article such as a cosmetic brush or a seal such that the article can be taken in and out by moving an operating knob forward and backward.

As a container of this type is, for example, known a stick-shaped prepared article container constructed such that a receiving tube holding a stick-shaped prepared article is accommodated in a tubular housing having an opening at its leading end and is movably supported in the longitudinal direction of the housing, a belt-shaped operative member is accommodated in the housing while being curved in U-shape and has one end thereof coupled to the receiving tube, the receiving tube is moved via the operative member by moving an operating knob mounted on the operative member from the outside of the housing forward and backward to take the stick-shaped prepared article in and out (e.g., see Japanese Unexamined Utility Model Publication No. 58-112214).

Such a container normally has a split structure of splitting the housing into two pieces in radial direction, and is assembled by mounting the receiving tube and the operative member in a guide groove and the like formed in the inner side surface of one split piece beforehand and mounting the operative member and the like in a guide groove formed in the other split piece while joining the other split piece with the one split piece. Thus, this container has a problem of a poor assembling operability.

Specifically, it is necessary to curve the belt-shaped operative member in U-shape while fitting it into the guide grooves and join the two split pieces together while maintaining such a state. For example, if an attempt is made to join the other split piece with the one split piece with the operative member assembled with the one split piece, the operative member frequently comes out of the guide grooves of the split pieces due to an occurrence of springback, thereby causing a problem of taking excessive time and labor in assembling the container. Particularly, in the case that the operative member has a high rigidity or is folded at a large radius of curvature, springback is likely to occur, resulting in an even worse assembling operability.

Further, since the prepared article is thought to be pushed back into the container of this type by a reaction force when the prepared article is pressed against something on which the prepared article is to be applied, it is necessary to effectively prevent it.

On this point, the container disclosed in the above publication is so constructed as to fixedly hold the prepared article in position by the engagement of the operating knob with a projection-shaped stopper provided at a movable end of the operating knob. By using the prepared article with the operating knob engaged with the stopper, the prepared article can be prevented from being pushed back into the container. However, this container can fixedly hold the prepared article in position only when the prepared article is completely pushed out (only in a state where the prepared article is most pushed out), and it has been impossible to fixedly hold the prepared article at any desired position according to a remaining amount.

There have been proposed such containers incorporated with a mechanism for locking a prepared article that an operating knob is moved to take the prepared article in and out, for example, while being pushed in to cancel locking and, when hand is released from the operating knob at the time of using the prepared article, the operating knob returns to a locked state by an elastic force of a spring or elastic element to lock the prepared article at a desired pushed-out position (e.g., see Japanese Unexamined Patent Publications Nos. 11-164730, 8-126525). However, these containers require two operations of: (1) pushing in the operating knob and (2) moving the operating knob when the prepared article is taken in and out and, accordingly, cumbersome to operate. Further, if the operating knob is forcibly moved by neglecting the operation (1), the locking mechanism may be damaged or broken.

SUMMARY OF THE INVENTION

An object of the present invention is to provide a container which overcomes the problems residing in the prior art and can move a contained article in its longitudinal direction.

According to an aspect of the present invention, a container comprises a tubular housing having an opening; an inner frame member separate from the housing, placed in the housing, and formed with a support section for accommodating an article to be contained and a guiding projection. Further, an operative member folded along and movable along the guiding projection is provided. A holder located in the support section for holding the article is provided at one end of the operative member, and an operating knob exposed to the outside of the housing is provided at the other end of the operative member. The holder is moved in a longitudinal direction of the housing by moving the operating knob in the longitudinal direction of the housing.

These and other objects, features, aspects, and advantages of the present invention will become more apparent from the following detailed description of the preferred embodiments/examples with reference to the accompanying drawings.

BRIEF DESCRIPTION OF THE DRAWINGS

FIGS. 6A, 6B and 6C are perspective views in partial section showing an assembling procedure of the stick-shaped prepared article container, wherein FIG. 6A shows a state where the operative member is inserted into the internal frame member, FIG. 6B shows a state during the insertion of the internal frame member and the like into the housing, and FIG. 6C shows a state where the internal frame member is inserted into the housing;

FIGS. 7A, 7B and 7C are sectional views showing used states of the stick-shaped prepared article container, wherein FIG. 7A shows a state where the prepared article is pushed out, FIG. 7B shows a state where the prepared article is used, and FIG. 7C shows a state where the prepared article is accommodated;

FIGS. 12A, 12B, 12C and 12D are sectional views showing used states of the stick-shaped prepared article container, wherein FIG. 12A shows a state immediately after the prepared article starts being pushed out, FIG. 12B shows a state where a lid is mostly moved at a lateral side of the container, FIG. 12C shows a state where the lid s completely moved to the lateral side of the container to completely open the leading end of the container, and FIG. 12D shows a state where the prepared article is pushed out;

DETAILED DESCRIPTION OF THE PREFERRED EMBODIMENTS OF THE INVENTION

Figure 1:
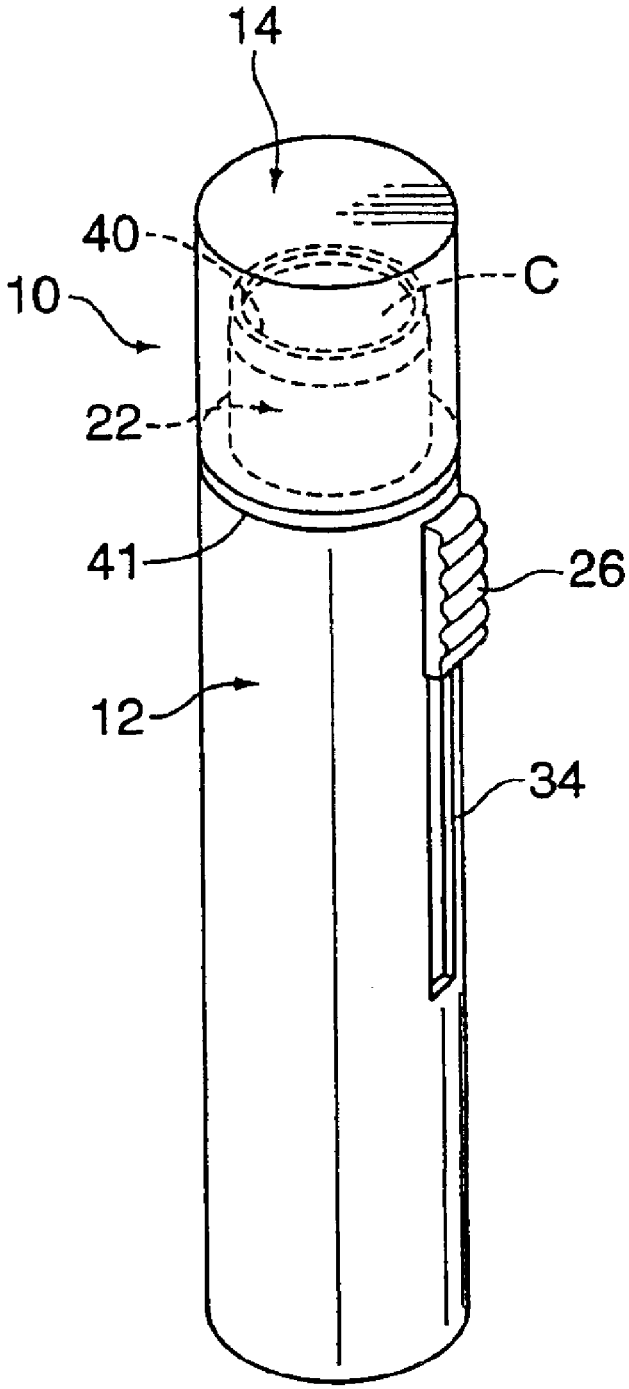
FIG. 1 is a perspective view showing a stick-shaped prepared article container provided with an operating knob according to an embodiment of the invention.
Figure 2:
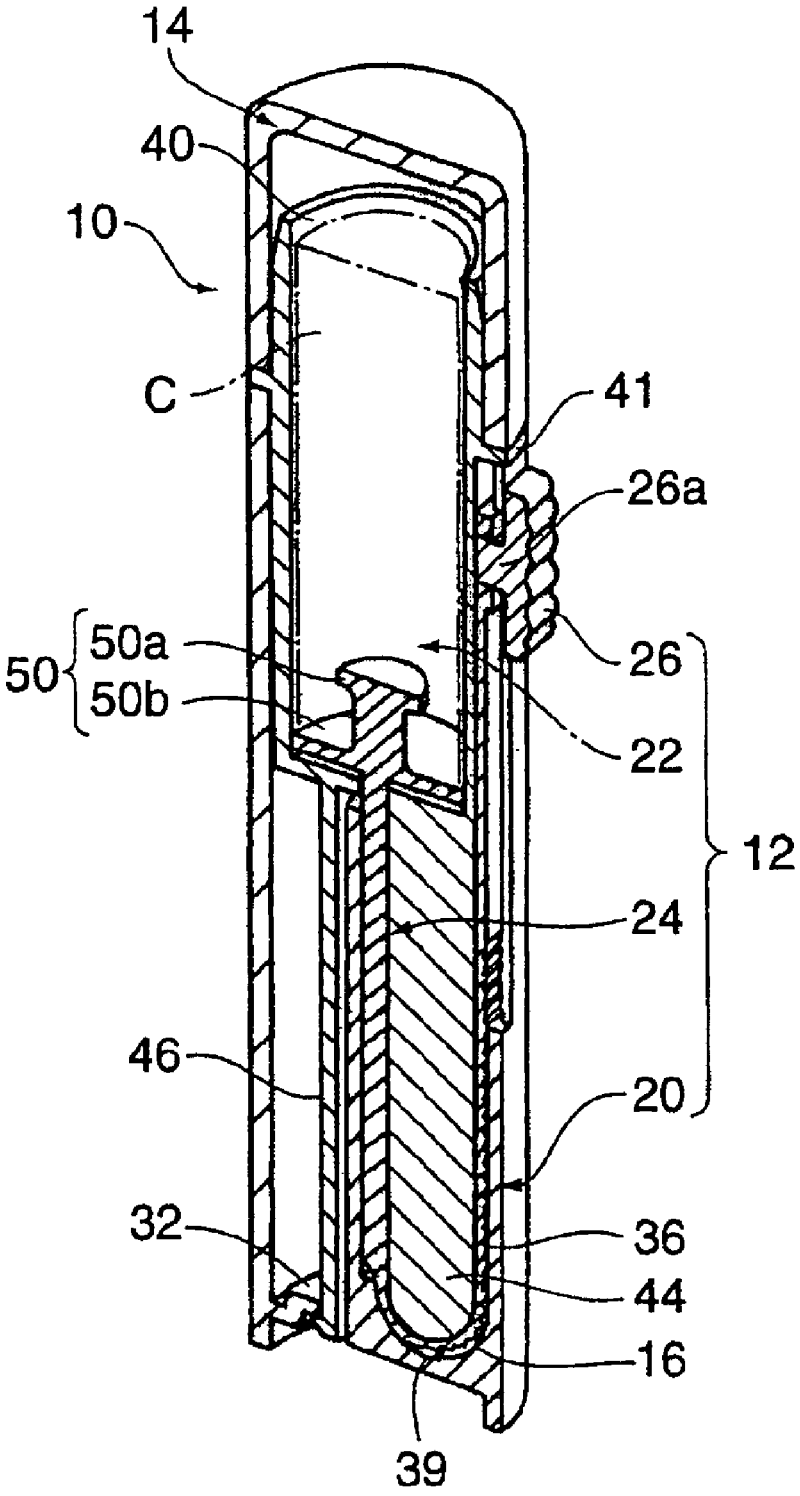
FIG. 2 is a vertical sectional view of the stick-shaped prepared article container.

With reference to FIGS. 1 and 2, a stick-shaped prepared article container provided with an operating knob according to an embodiment of the present invention is described. A stick-shaped prepared article container 10 (hereinafter, merely "container 10") is provided with a tubular main body 12 for accommodating a stick-shaped prepared article C (article) such as a lip stick and a cap 14 to be detachably mountable on the leading end (upper end) of the main body 12 and is constructed such that the prepared article C can be taken in and out of the main body 12 by moving an operating knob 26 provided on the side surface of the main body 12 forward and backward along longitudinal direction along the main body 12 while the main body 12 is gripped by a user with the cap detached.

The main body 12 of the container 10 is, as shown in FIG. 2, comprised of a total of four parts: a housing 20, an internal frame member 22, an operative member 24 and the operating knob 26, and is formed by assembling these parts together.

Figure 3A:
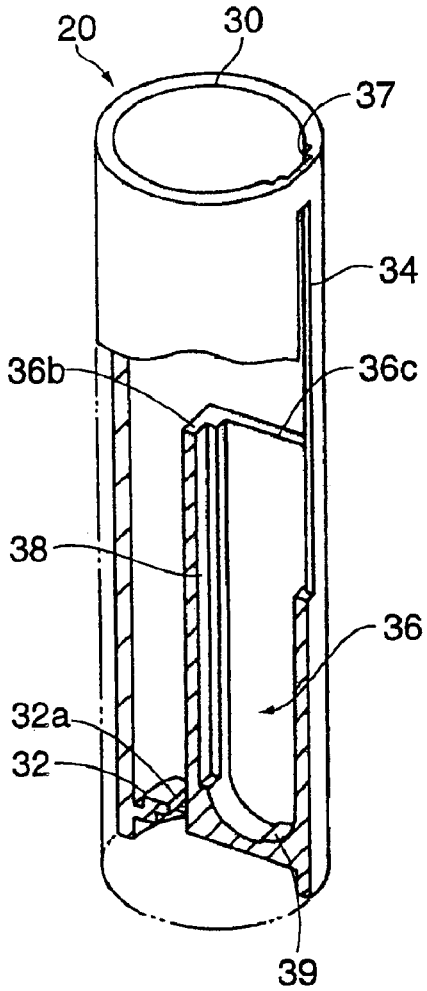
FIGS. 3A and 3B are a perspective view in partial section and a plan view in section showing a housing forming a main body of the stick-shaped prepared article container, respectively.
Figure 3B:
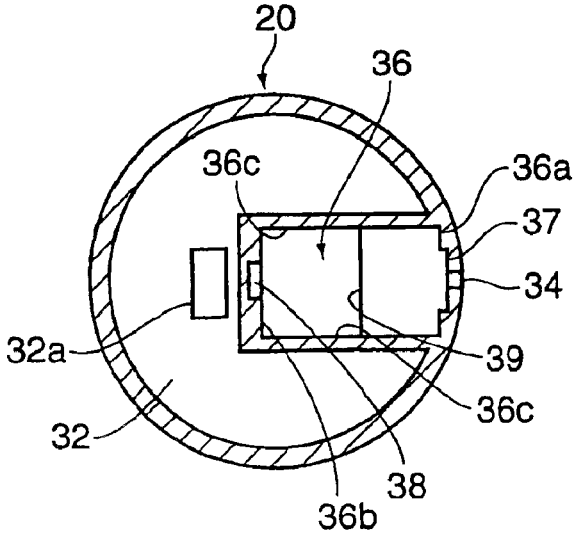

The housing 20 is a part forming the outer configuration of the container 10 and has a bottomed tubular shape provided with a leading-end opening 30 and has a slit formed in its side surface to extend from the leading end to a middle portion along vertical direction (longitudinal direction of the housing 20, lengthwise direction) as shown in FIGS. 3A and 3B.

Inside the housing 20 is defined a guiding recess 36 which has a substantially rectangular cross section, extends from a bottom portion 32 of the housing 20 to the middle portion and is open toward the leading end. This recess 36 is made up of an inner wall surface (specifically inner wall of a portion of the housing 20 corresponding to the slit 34; hereinafter referred to as inner wall 36*a*) of the housing 20, an opposite wall 36*b* opposed to the inner wall 36*a*, and a pair of parallel side walls 36*c* coupling the walls 36*a* and 36*b*. As described later, the guiding recess 36 cooperates a guide projection 44 of the internal frame member 22 to form a guiding path 16 for the operative member 24.

The bottom surface of the recess 36 is an arcuate surface having a U-shaped cross section. A step-shaped claw portion 39 is formed on the arcuate bottom surface and engageable with engaging teeth 54 of the operative member 24 to be described later. A guide groove 38 is so formed in the opposite wall 36*b* of the inner wall surfaces of the recess 36 as to vertically extend straight from the upper end to the proximity of the bottom end for guiding a guiding portion 24*a* of the operative member 24.

A guide groove 37 vertically extending straight along the slit 34 is formed at a position of the inner wall surface of the housing 20 corresponding to the slit 34, and a knob mounting portion 56 of the operative member 24 to be described later is guidable along this guide groove 37. Further, a locking hole 32*a* (engageable portion) for fixing the inner frame member 22 vertically penetrates the bottom portion 32 of the housing 20 outside the recess 36, specifically at an immediate rear side (left side in FIG. 3B) of the opposite wall 36*b*.

Figure 4A:
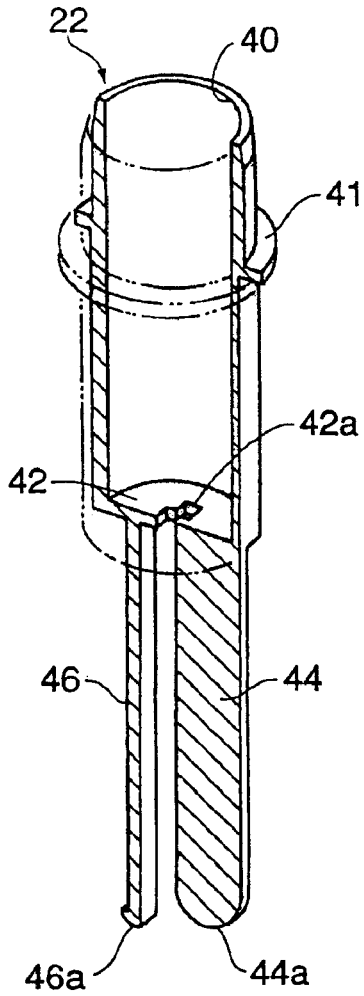
FIGS. 4A and 4B are a perspective view in partial section and a plan view in section showing an internal frame member forming the main body of the stick-shaped prepared article container, respectively.
Figure 4B:
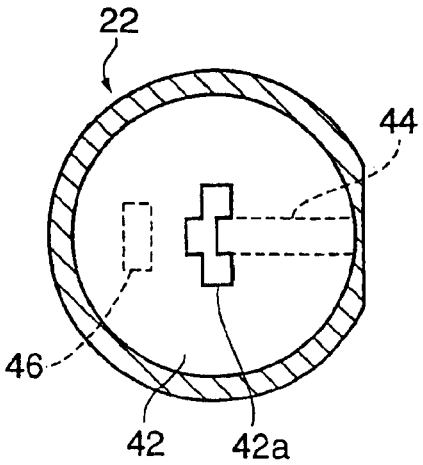

The inner frame member 22 is a part for directly containing the prepared article C to be accommodated in the housing 20 and has a hollow cylindrical shape formed with a leading-end opening 40 as shown in FIGS. 4A and 4B.

The dimensions of the outer shape of the inner frame member 22 are set such that the inner frame member 22 can be inserted into the housing 20 without leaving any clearance therebetween, and a jaw portion 41 having the same outer diameter as the housing 20 is integrally formed near the leading end of the inner frame member 22.

A hollow support section for supporting the prepared article C is formed at an upper part of the inner frame member 22, whereas the guiding projection 44 and a locking piece 46 are formed at a lower part of the inner frame member 22. The guiding projection 44 extends downward, and the narrow locking piece 46 is provided in parallel with the guiding projection 44. These guiding projection 44 and locking piece 46 are integrally formed with a partition wall 42 defining the hollow support section.

The guiding projection 44 is a projection in the form of a flat plate extending in a radial direction from a center longitudinal axis of the inner frame member 22 as shown in FIG. 4B, and an arcuate guide surface 44*a* is formed at its bottom end. On the other hand, the locking piece 46 is provided at a side opposite from the guiding projection 44 with respect to the center longitudinal axis of the inner frame member 22 and a hook 46*a* is integrally formed at its bottom end.

A through hole 42*a* used to insert the operative member 24 vertically penetrates the partition wall 42. This through hole 42*a* has such a shape corresponding to the cross section of the later-described guiding portion 24*a* of the operative member 24, and is so provided adjacent to the guiding projection 44 that a pair of elongated projections 52*a* formed on the operative member 24 automatically hold the guiding projection 44 from opposite sides (i.e., the guiding projection 44 is located between the two elongated projections 52*b*) when the operative member 24 is inserted.

Figure 5A:
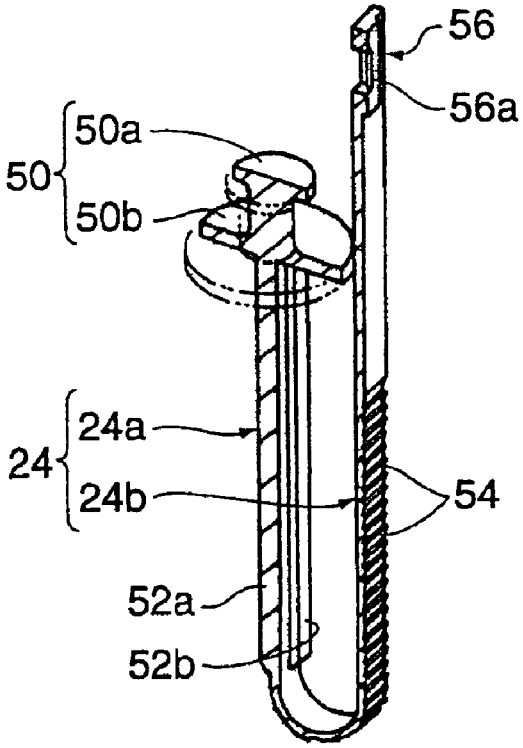
FIGS. 5A, 5B and 5C are perspective views in partial section showing an operative member forming the main body of the stick-shaped prepared article container, an enlarged perspective view showing a knob mounting portion, and a plan view in section showing the operative member, respectively.

As shown in FIG. 5A, the operative member 24 is a long and narrow part used to push the prepared article C in and out, and a holder 50 (holding element) for the prepared article C is integrally provided at one end thereof. In FIG. 5A, the operative member 24 is shown to be folded at its intermediate position in view of the drawing space.

The holder 50 has a double disk structure provided with a small-diameter disk 50*a* and a large-diameter disk 50*b*, the former being located above the latter. The outer shape of the large-diameter disk 50*b* is so dimensioned that the disk 50*b* can be smoothly slidable in the hollow support section of the inner frame member 22 along vertical direction while leaving no clearance between it and the support section. As described later, the prepared article C is supported on an end surface of the large-diameter disk 50*b* with the small-diameter disk 50*a* of the holder 50 embedded in one end (bottom end) of the shaft-shaped prepared article C.

The operative member 24 is substantially in the form of a flat plate except the holder 50, and has the guiding portion 24*a* provided at a base end side and continuous with the holder 50 and a belt portion 24*b* at a leading end side.

Figure 5B:
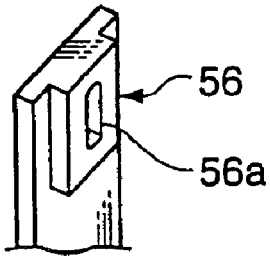
Figure 5C:
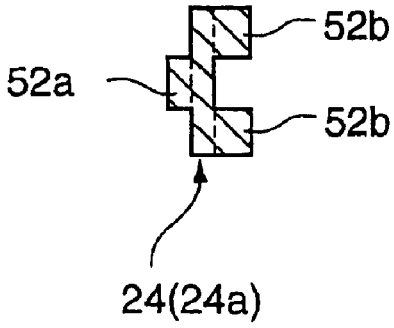

The guiding portion 24*a* has a certain degree of rigidity and is constructed such that vertically extending projections for guiding are formed on its front and rear surfaces. Specifically, as shown in FIG. 5C, one elongated projection 52*a* is formed at the widthwise (vertical direction in FIG. 5C) center of one surface (left surface in FIG. 5C: hereinafter referred to as front surface) of the guiding portion 24*a*, and the pair of elongated projections 52*b* are formed at the opposite widthwise ends of the opposite surface (hereinafter referred to as rear surface).

On the other hand, the belt portion 24*b* has a sufficient flexibility. A plurality of engaging teeth 54 like sawteeth engageable with the claw portion 39 formed in the housing 20 are formed on the front surface of the belt portion 24*b* in a specified range extending from the proximity of an end portion of the guiding portion 24*a*. The detailed constructions of the claw portion 39 and the engaging teeth are described later.

The knob mounting portion 56 projects from the front surface of the leading end of the belt portion 24*b* (leading end of the operative member 24). This knob mounting portion 56 is formed with a mount hole 56*a* for the operating knob 26 as shown in FIG. 5B.

As shown in FIGS. 1 and 2, the operating knob 26 has a main section having an anti-slip unevenness on its front surface as an operation surface, and a hook 26*a* used to mount the operative member (knob mounting portion 56) is integrally formed on the rear surface of the operating knob 26.

The main body 12 is assembled from the parts constructed as above. An assembling procedure is described below.

Figure 6A:
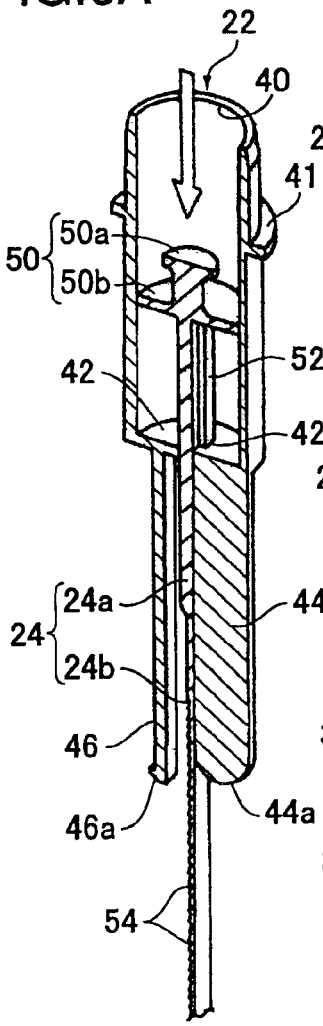

First, the operative member 24 is inserted into the inner frame member 22 as shown in FIG. 6A. Specifically, the operative member 24 is drawn out to below the support section with the holder 50 left in the support section by being inserted into a support section of the inner frame member 22 from the leading end of the belt portion 24*b* and introducing the operative member 24 through the through hole 42*a* formed in the partition wall 42. At this time, when the operative member 24 is inserted through the through hole 42*a*, the guiding projection 44 is located between the pair of elongated projections 52*b* formed on the rear surface of the guiding portion 24*a*, whereby the operative member 24 is guided along the guiding projection 44.

Figure 6B:
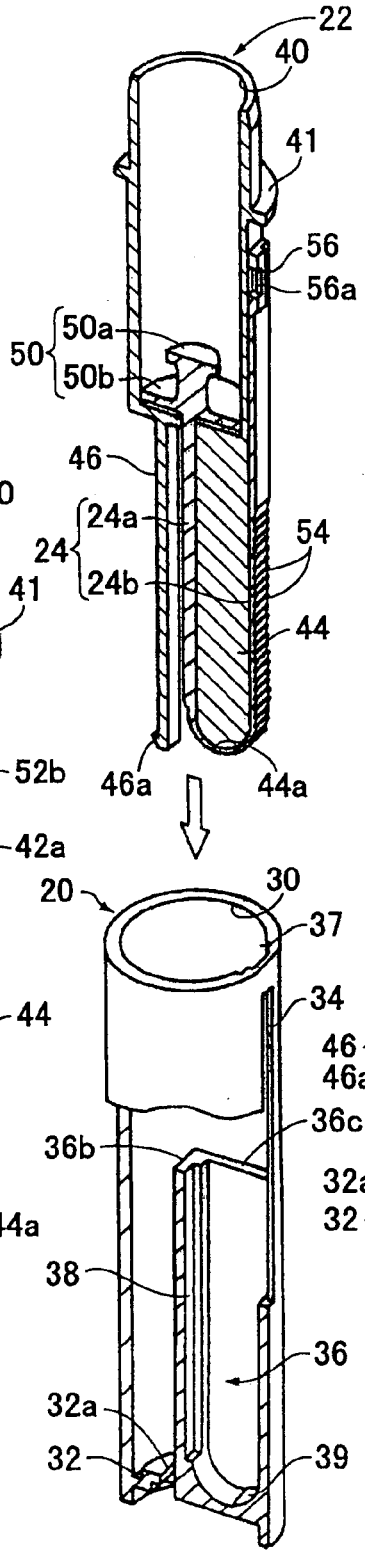

After the operative member 24 is mounted into the inner frame member 22, the belt portion 24*a* thereof is folded in U-shape by the guide surface 44*a* along the guiding projection 44 of the inner frame member 22 and is held along the outer surface of the inner frame member 22 as shown in FIG. 6B. At this time, the operative member 24 may be folded by being pulled down with the holder held in abutment against the partition wall 42, and the inner frame member 22 may be held together with the knob mounting portion 56 of the operative member 24 in this state.

In this state, the inner frame member 22 is inserted into the housing 20 through the leading-end opening 30 from the leading end side of the guiding projection 44, and a portion of the inner frame member 22 corresponding to the guiding projection 44 is inserted into the recess 36 inside the housing 20. At this time, the inner frame member 22 and the like are inserted into the housing 20 while fitting the elongated projection 52*a* formed on the guiding portion 24*a* of the operative member 24 into the guide groove 38 formed in the opposite wall 36*b* of the recess 36 and fitting the knob mounting portion 56 into the guide groove 37.

When the inner frame member 22 and the like are completely inserted into the housing 20 in this way, i.e., the inner frame member 22 and the like are inserted up to a position where the jaw portion 41 of the inner frame member 22 comes into contact with an opening edge at the leading end of the housing 20, the hook 46*a* at the leading end of the locking piece 46 of the inner frame member 22 is inserted into the locking hole 32*a*, thereby engaging the locking piece 46 with the bottom portion 32 of the housing 20, with the result that the inner frame member 22 and the like are so assembled into the housings as not to come out. Further, the guiding path 16 having a U-shaped cross section for guiding the operative member 24 is formed between the guiding projection 44 of the inner frame member 22 and the inner wall of the recess 36 as shown in FIG. 2.

Figure 6C:
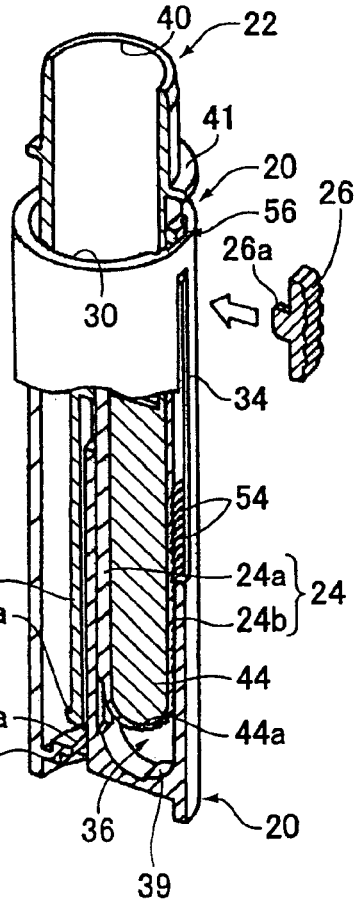

After the inner frame member 22 and the like are assembled into the housing 20, the hook 26*a* of the operating knob 26 is inserted into the slit 34 from outside the housing 20 to be inserted into the mount hole 56*a* formed in the knob mounting portion 56 of the operative member 24 as shown in FIG. 6C. In this way, the hook 26*a* is engaged with the knob mounting portion 56 via the mount hole 56*a* to fix the operating knob 26 to the operative member 24.

The main body 12 is completed by completing the fixing of the knob mounting portion 56 as above. The cap 14 has such a hollow cylindrical shape having substantially the same outer diameter as the housing 20, and is mountable on the main body 12 at its upper end portion, precisely at a portion of the main body 12 above the jaw portion 41 of the inner frame member 22.

In the container 10 constructed as above, the prepared article C is accommodated in the support section of the inner frame member 22 of the main body 12 while being supported by the operative member 24. More specifically, the prepared article C is accommodated while having the small-diameter disk 50*a* of the holder 50 embedded at the bottom end thereof and being supported from below by the large-diameter disk 50*b*. In this way, the holder 50 and the prepared article C are integrally movable in the support section of the inner frame member 22.

While the prepared article C is not used, the operating knob 26 is located near the upper end of the slit 34 to accommodate the prepared article C in the main body 12 (pulled-in state) as shown in FIG. 2. By mounting the cap 14 on the upper end portion of the main body 12 in this state, the prepared article C can be protected from drying.

Figure 7A:
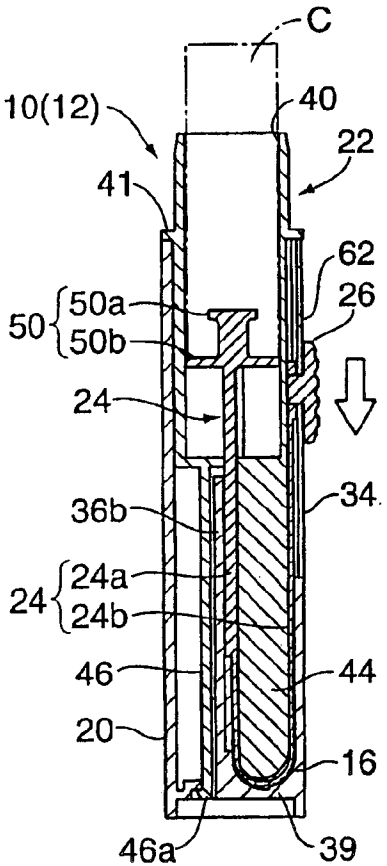

When the prepared article C is to be used, the cap 14 is detached and the operating knob 26 is pushed down along the slit 34 as shown in FIG. 7A while the main body 12 is gripped. If the operating knob 26 is pushed down, the operative member 24 moves together with the operating knob 26, with the result that the prepared article C is moved upward together with the holder 50 in the inner frame member 22 and is pushed out toward the leading end of the main body 12 as shown in FIG. 7C. Thus, if the prepared article C is, for example, a lipstick, the lipstick can be put on by being pressed against lips while being pushed toward the leading end of the main body 12.

If the operating knob 26 is conversely pushed up to the upper end of the slit 34 after the use, the prepared article C is moved downward together with the holder 50 in the support section of the inner frame member 22, with the result that the prepared article C can be accommodated into the main body 12.

In this container 10, the prepared article C is taken in and out by operating the operating knob 26 as described above. While the prepared article C is being used, it is necessary to prevent the prepared article C from being pushed back into the main body 12 even if hand is released from the operating knob 26. Specifically, a force to push the prepared article C back into the main body 12 (reaction force) acts due to a pressing force (force to press the lipstick against the lips if the prepared article C is a lipstick) acting at the time of using the prepared article C. Thus, it is necessary to prevent the prepared article C from being pushed back into the main body 12 by this reaction force. In view of this point, in this container 10, the engaging teeth 54 are provided on the belt portion 24*b* of the operative member 24, the claw portion 39 engageable with the engaging teeth 54 is provided in the housing 20 as described above, and the guiding path 16 for guiding the belt portion 24*b* and the like is constructed as follows in order to satisfactorily prevent the prepared article C being used from being pushed back.

Specifically, the engaging teeth 54 and the claw portion 39 are so shaped such that they are not engaged when the operative member 24, i.e., the belt portion 24*b* is moved in such a direction as to push the prepared article C out by operating the operating knob 26 and are conversely engaged when the operative member 24 is moved in an opposite direction, i.e., in a direction to accommodate the prepared article C (hereinafter, "accommodating direction") (see FIG. 8). Further, a portion of the guiding path 16 corresponding to a turned portion of the operative member 24 and a portion thereof located more toward the operating knob 26 (portion at the right side of the claw portion 39 in FIG. 8) from the turned portion is widened in relation to the thickness of the belt portion 24*b* to provide a vertical margin. This margin is set such that the engaging teeth 54 and the claw portion 39 are not engaged with the belt portion 24*b* held in contact with the guiding projection 44 (see FIG. 9).

Thus, at the time of pushing the prepared article C out, the engaging teeth 54 and the claw portion 39 are not engaged and, therefore, the operative member 24 is smoothly moved along the guiding path 16 as the operating knob 26 is operated. As a result, the prepared article C can be smoothly pushed out.

Figure 7B:
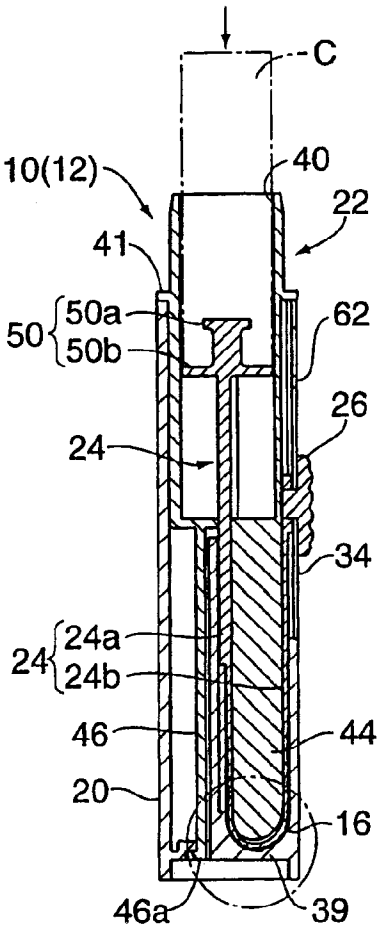
Figure 7C:
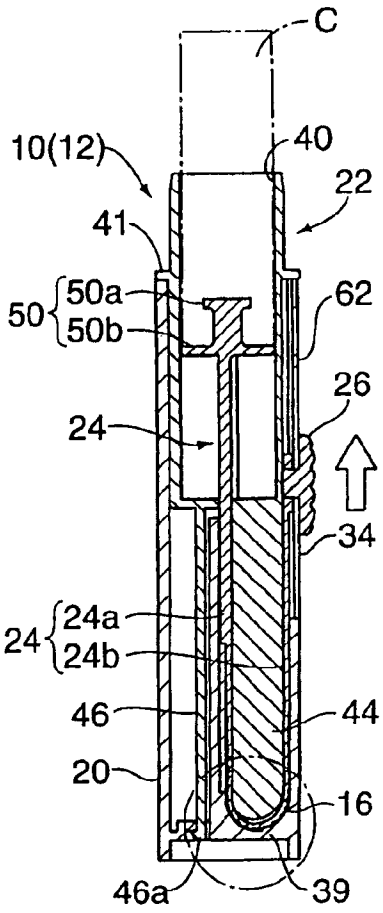
Figure 8:
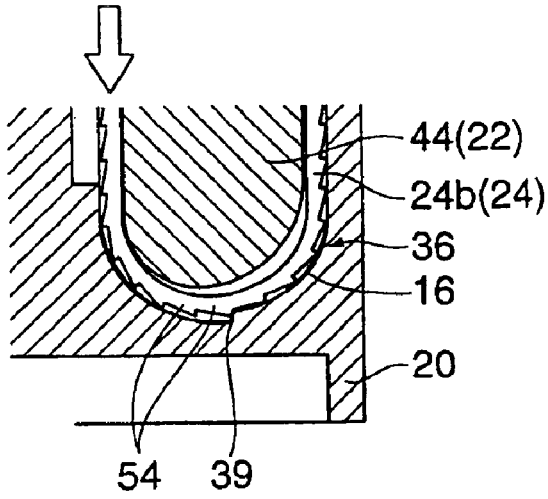
FIG. 8 is an enlarged sectional view of an essential portion (or circular portion shown in phantom line in FIG. 7B) of FIG. 7B showing a relationship between engaging teeth of the operative member and a claw portion.

When a reaction force, i.e., a force to push the prepared article C back (load acting in the accommodating direction) acts on the prepared article C being used as shown by an arrow in FIG. 7B, the movement of the operative member 24 in the accommodating direction along the guiding path 16 is hindered by the engagement of the engaging tooth 54 and the claw portion 39 as shown in FIG. 8. This prevents the prepared article C from being pushed back into the main body 12. In other words, since the operative member 24 (belt portion 24*b*) is folded in U-shape at the bottom end of the housing 20, if the reaction force acts on the prepared article C as shown by an arrow in FIG. 8, the belt portion 24*b* is resiliently deformed toward the lower surface (toward the claw portion 39) in the guiding path 16, with the result that the engaging tooth 54 and the claw portion 39 are engaged to prevent the prepared article C from being pushed back.

Figure 9:
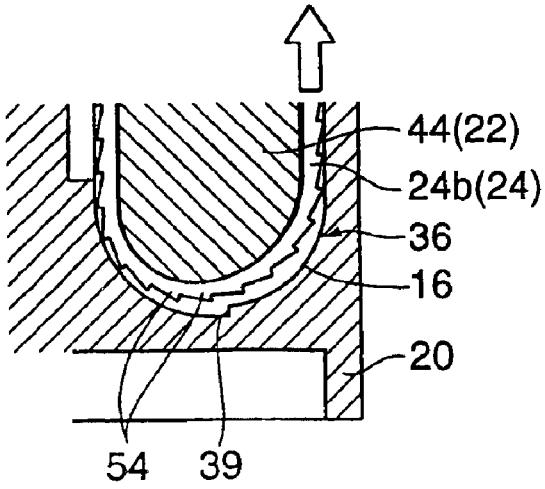
FIG. 9 is an enlarged sectional view of an essential portion (or circular portion shown in phantom line in FIG. 7C) of FIG. 7C showing a relationship between the engaging teeth of the operative member and the claw portion.

If the operating knob 26 is moved upward as shown in FIG. 7C to accommodate the prepared article C into the main body 12 in this state, the prepared article C and the like become a load and a tensile load acts on the operative member 24. As a result, the belt portion 24*b* slides along the upper surface (along the guide surface 44*a* of the guiding projection 44) in the guiding path 16 as shown in FIG. 9. Thus, the engaging teeth 54 and the claw portion 39 are disengaged to permit the movement of the operative member 24 in the accommodating direction, with the result that the prepared article C is smoothly accommodated into the main body 12 as the operating knob 26 is operated.

In this way, the prepared article C can be smoothly taken in and out by operating the operating knob 26 and, regardless of the pushed-out state (amount) of the prepared article C, the prepared article C can be securely prevented from being pushed back into the container 10 by the reaction force acting during the use.

The aforementioned construction for preventing the prepared article C from being pushed back is fairly simple because a difference in the degree of deformation of the operating knob 24 in the guiding path 16 (turned portion; portion having a U-shaped cross section and facing the claw portion 39) is taken advantage of as described in detail above. Further, this construction has not influence on the operability of the operating knob 26. In other words, it is sufficient to move the operating knob 26 forward and backward along the slit 32 when the prepared article C is used, and no other special operation specifically including a two-step operation of pushing the operating knob in and moving it in this state as in the prior art container of this type is necessary. Therefore, the operability of the operating knob 26 is not impaired by the above construction at all.

In the basic construction for taking the prepared article C in and out via the operative member 24 by operating the operating knob 26, the prepared article C being used is prevented from being pushed back by integrally providing the engaging teeth 54 on the operative member 24 and integrally providing the claw portion 39 engageable with the engaging teeth 54 in the housing 20. Thus, the prepared article C can be prevented from being pushed back by a rational construction. For example, it may be considered to separately provide a special member for preventing the prepared article C from being pushed back and to incorporate this member into the container main body or the like. In such a case, the number of parts of the container increases, leading to increases in production cost and the number of assembling steps. Contrary to this, the container 10 constructed such that the parts essential to the container 10, i.e., the operative member 24 and the housing 20 are also used to prevent the prepared article C from being pushed back has an effect that the prepared article C can be satisfactorily prevented from being pushed back while being hardly accompanied by increases in production cost and the number of assembling steps.

A stopper 62 (see FIGS. 7 and 13) comprised of a pair of opposed projections is provided near the upper end of the slit 34. When the operating knob 26 is set at an upper end position, the operating knob 26 and the stopper 62 are engaged to fixedly hold the operating knob 26 at the upper end position. This prevents the prepared article C from being pushed out by an inadvertent movement of the operating knob 26 while the container 10 is carried around. Further, a user notices a click when the prepared article C is accommodated and, therefore, can recognize by feeling at his fingertips that the prepared article C has been accommodated.

The container 10 constructed as above has the following effects.

First, the assembling operability of the container 10 can be improved. Specifically, since this container 10 is assembled by inserting the operative member 24 into the inner frame member 22, folding it in U-shape, and inserting the inner frame member 22 and the like through the leading-end opening 30 of the housing 20 with the end of the operative member 24 gripped together with the inner frame member 22 as described above, the operative member 24 can be easily assembled into the housing 20 while being folded in U-shape without the operative member 24 experiencing any springback. Thus, as compared to the prior art container of this type in which the springback of the operative member is likely to occur during the assembling, the container 10 can be more easily and quickly assembled. Therefore, the assembling operability of the container 10 can be improved.

Particularly, the inner frame member 22 and the like can be easily fixed to the housing 20 since the locking piece 46 provided in the inner frame member 22 is engaged with the housing 20 to fix the inner frame member 22 and the like to the housing 20 when the inner frame member 22 and the like are completely inserted into the housing 20. Further, since the inner frame member 22 and the like are inserted into the housing 20 while the elongated projections 52*a* formed on the guiding portion 24*a* of the operative member 24 are guided along the guide groove 38 formed in the recess 36 of the housing 20 and the knob mounting portion 56 is guided along the guide groove 37 as described above, an orientation error at the time of insertion can also be prevented. Furthermore, since the inner frame member 22 and the like are inserted into the housing 20 while the knob mounting portion 56 is being guided along the guide groove 37 formed along the slit 34 as described above, the position of the knob mounting portion 56 can be easily specified when the operating knob 26 is mounted. Thus, the operating knob 26 can be easily and quickly mounted from the outside of the housing 20. These points also contribute to the improved assembling operability of the container 10.

In the basic construction of the above container 10 for taking the prepared article C in and out via the operative member 24 by operating the operating knob 26, the prepared article C being used is prevented from being pushed back by integrally providing the engaging teeth 54 on the operative member 24 and integrally providing the claw portion 39 engageable with the engaging teeth 54 in the housing 20. Thus, the prepared article C can be advantageously prevented from being pushed back by the rational construction. For example, it may be considered to separately provide a special member for preventing the prepared article C from being pushed back and to incorporate this member into the housing or the like. In such a case, the number of parts of the container increases, leading to increases in production cost and the number of assembling steps. Contrary to this, the container 10 constructed such that the parts essential to the container 10, i.e., the operative member 24 and the housing 20 are also used to prevent the prepared article C from being pushed back has an effect that the prepared article C can be satisfactorily prevented from being pushed back while being hardly accompanied by increases in production cost and the number of assembling steps.

Further, the construction for preventing the prepared article C from being pushed back in the container 10 has a fairly simple construction since it takes advantage of the difference in the degree of deformation of the operative member 24 in the guiding path 16 (turned portion; portion corresponding to the claw portion 39) as described above, and has no influence on the operability of the operating knob 26. In other words, the prepared article C can be satisfactorily taken in and out by moving the operating knob 26 forward and backward along the slit 34 similar to the conventional container of this type, and no other special operation is necessary.

Since the rigid guiding portion 24*a* of the operative member 24 is provided immediately below the holder 50 in this container 10, operability of pushing the prepared article C out can be improved. Specifically, the entire operative member 24 may be flexible like the belt portion 24*b*, for example, without providing the guiding portion 24*a*. However, in such a case, if a compression load acts on the operative member 24 at the time of pushing the prepared article C out, the operative member 24 is deflected in the inner frame member 22 as the prepared article C is pushed out. As a result, a sense of incongruity that the prepared article C is not sufficiently pushed out is thought to be given to a user. Contrary to this, according to the construction of this embodiment, the rigid guiding portion 24*a* is provided at the bottom end of the holder 50 and is vertically movable straight along the guiding projection 44. Thus, the operative member 24 does not experience the above deflection at all. Therefore, the prepared article C can be properly pushed out by an amount corresponding to the operation of the operating knob 26 and a sense of incongruity is not given to the user.

Figure 10:
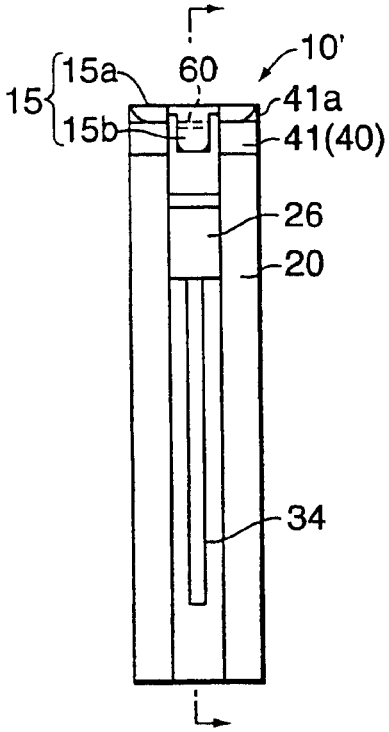
FIG. 10 is a front view of a stick-shaped prepared article container provided with an operating knob according to another embodiment of the invention.
Figure 11:
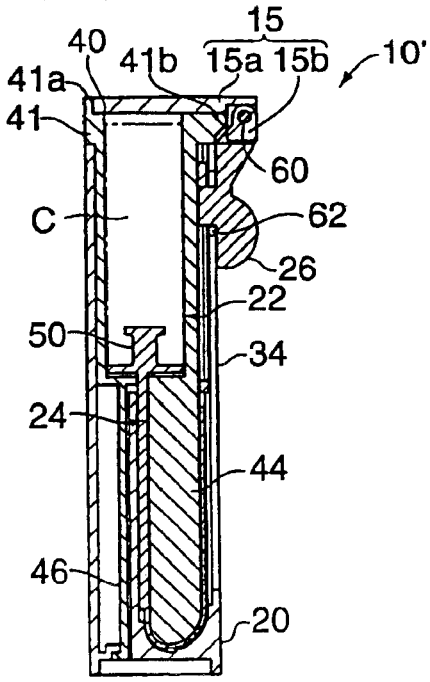
FIG. 11 is a sectional view of the stick-shaped prepared article container.

Next, a second embodiment of the present invention is described. FIGS. 10 and 11 schematically show a stick-shaped prepared article container provided with an operating knob according to the second embodiment. It should be noted that, since a basic construction of the stick-shaped prepared article container shown in FIGS. 10 and 11 is common to the container 10 of the first embodiment, no description is given on the common elements by identifying them by the same reference numerals and only points of difference are described in detail below.

A container 10' of the second embodiment is not provided with the cap 14 unlike the container 10 of the first embodiment and, instead, the main body 12 is integrally provided with a lid 15 for opening and closing the leading-end opening of the main body 12, i.e., the leading-end opening 40 of the inner frame member 22.

This lid 15 is provided with a lid main body 15*a* in the form of a flat plate for opening and closing the leading-end opening 40 and a coupling portion 15*b* projecting from an end edge of the lid main body 15*a* and has an inverted L-shaped cross section (inverted L-shape in FIG. 11). The lid 15 is rotatably supported at the upper end of the operating knob 26 via a shaft 60.

In the main body 12, the inner frame member 22 is not provided with the mounting portion for the cap 14 unlike the first embodiment and, instead, a rib 41*a* having a substantially annular plan view and fittable on the lid 15 is integrally formed atop the jaw portion 41. In other words, when the lid 15 is closed, the lid main body 15*a* of the lid 15 is engaged with the rib 41*a* as shown in FIGS. 10 and 11, and the lid 15 is held at a closed position shown in FIGS. 10 and 11 by this engaging force.

Further, a cam 41*b* (cam portion) projects in a radially outward direction (radially outward direction of the inner frame member 22: rightward in FIG. 11) at a position of the jaw portion 41 corresponding to the coupling portion 15*b* of the lid 15.

Although not shown in detail, the operative member 24 is provided with the knob mounting portion 56 including the mount hole 56*a* narrow and long in vertical direction (longitudinal direction), the mount hole 56 being used as a mount hole for the operating knob 26. Thus, the operating knob 26 is relatively movable with respect to the operative member 24 within a range of the mount hole 56*a*. As described later, a vertical (longitudinal) dimension of the mount hole 56*a* is set at a value sufficient for the lid 15 to move to a lateral side of the main body 12 to open the leading-end opening 40 as the prepared article C is pushed out by means of the operating knob 26.

In the container 10' of the second embodiment thus constructed, the operating knob 26 is located near the upper end of the slit 34 to accommodate the prepared article C in the main body 12 and the lid 15 is set at the closed position, i.e., at a position where it closes the leading-end opening 40 as shown in FIGS. 10 and 11 while the prepared article C is not used.

Figure 12A:
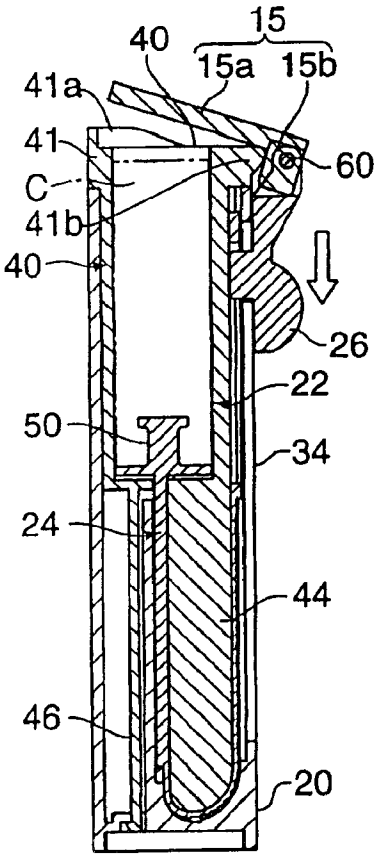

When the prepared article C is to be used, the operating knob 26 is moved down along the slit 34 as shown in FIG. 12A with the main body 12 held.

Figure 12B:
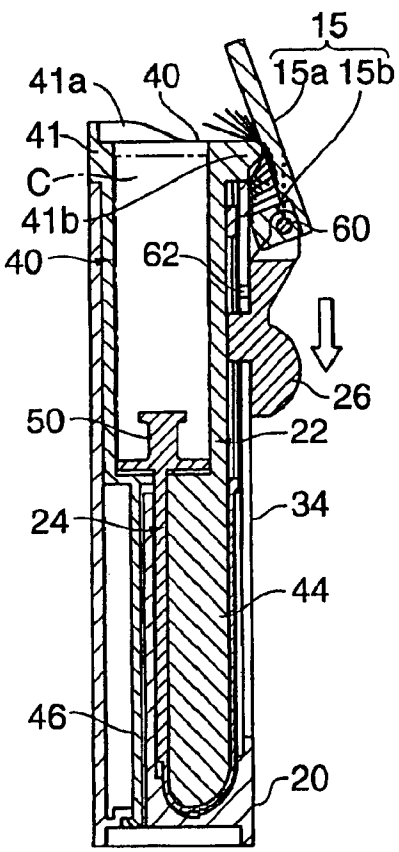
Figure 12C:
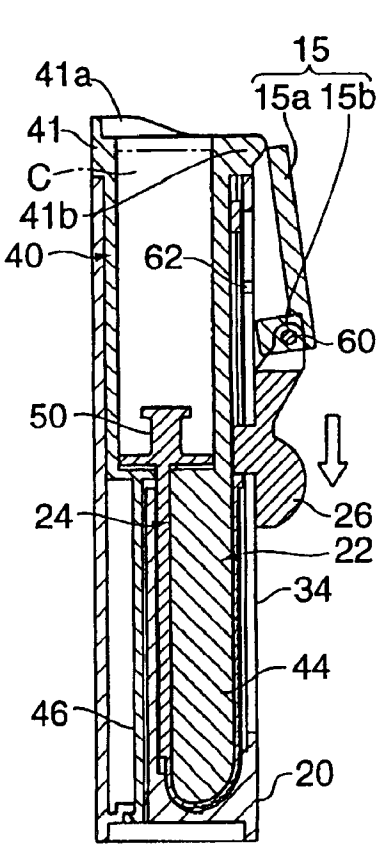

When the operating knob 26 is moved down in this way, only the operating knob 26 is first relatively moved with respect to the operative member 24, and the lid 15 is accordingly moved from the leading end (upper end) of the main body 12 to the lateral side, thereby starting to open the leading-end opening 40 as shown in FIG. 12B. When the operating knob 26 is moved to the bottom end of the mount hole 56*a* of the knob mounting portion 56, a distal end (upper end in FIG. 12C) of the lid 15 is completely moved to the lateral side of the main body 12 to completely open the leading-end opening 40 as shown in FIG. 12C.

Figure 12D:
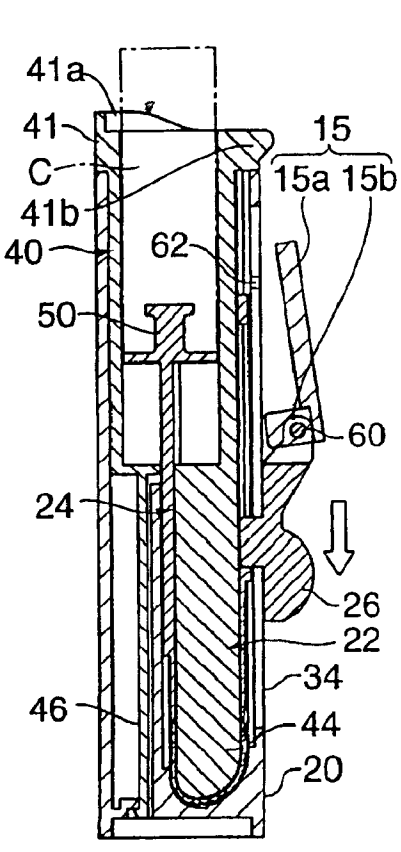

When being further pushed down, the operating knob 26 is engaged with the operative member 24. Thereafter, the prepared article C is pushed out toward the leading end of the main body 12 as shown in FIG. 12D by the movement of the operative member 24 caused by the movement of the operating knob 26.

After being used, the prepared article C can be accommodated into the main body 12 by conversely moving the operating knob 26 upward. At this time, when the operating knob 26 is moved upward, only the operating knob 26 is relatively moved with respect to the operative member 24 within the range of the mount hole 56*a*. When being moved to the upper end of the mount hole 56*a*, the operating knob 26 is engaged with the operative member 24. Thereafter, the prepared article C is accommodated into the main body 12 by the movement of the operative member 24 caused by the movement of the operating knob 26. At this time, when the operating knob 26 reaches a position near the upper end of the slit 34, the coupling portion 15*b* of the lid 15 comes into contact with the cam 41*b*, whereby the lid 15 is rotated about the shaft 60. When the operating knob 26 is completely pushed up, the prepared article C is accommodated and the leading-end opening 40 is completely closed by the lid 15 as shown in FIGS. 10 and 11.

Figure 13:
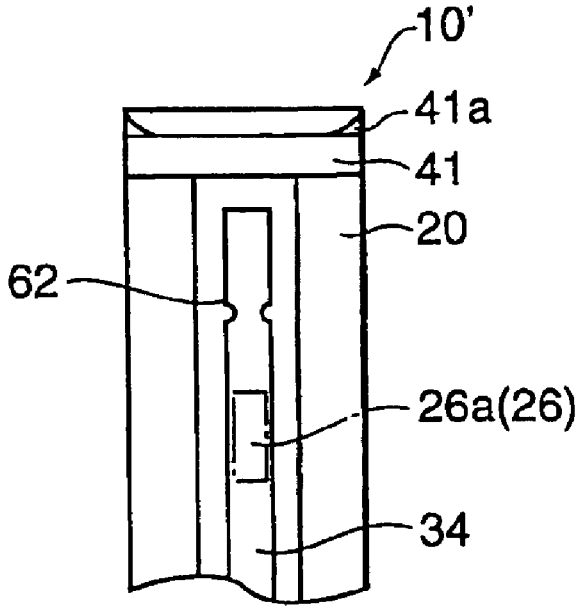
FIG. 13 is a fragmentary front view of the stick-shaped prepared article container showing a stopper for the operating knob provided in a slit.

In this container 10' as well, the stopper 62 comprised of a pair of opposed projections is provided near the upper end of the slit 34 as shown in FIGS. 11 and 13. When the operating knob 26 is set at the upper end position, i.e., at a position where the leading-end opening 40 is closed by the lid 15, the operating knob 26 and the stopper 62 are engaged to fixedly hold the operating knob 26 at the upper end position. This prevents the lid 15 from being inadvertently opened and the prepared article C from being pushed out while the container 10' is carried around. Further, a user notices a click when the prepared article C has been accommodated and, therefore, can recognize by feeling at his fingertips that the prepared article C is accommodated. In order to more securely hold the leading-end opening 40 closed by the lid 15, a biasing device comprised of an elastic element such as a spring for biasing the operating knob 26 in such a direction to close the lid 15 (direction to rotate the lid 15 to the closed position) may be incorporated, for example, into the operating knob 26, the lid 15 and the like.

According to the container 10' of the second embodiment as described above, since the opening and closing operations of the lid 15 are linked with the operations of taking the prepared article C in and out by means of the operation knob 26, a series of operations of taking the prepared article C in and out including the opening and closing operations of the lid 15 can be easily performed by one hand. Thus, in addition to the effects of the container 10 of the first embodiment, operability can be further improved. There is also an effect of preventing a loss of the lid 15 since the lid 15 is integrally assembled with the main body 12.

Further, in the container 10', the prepared article C is not pushed out until the lid 15 is completely moved to the lateral side of the main body 12 even if the operating knob 26 is operated to push the prepared article C out. Thus, the lid 15 integrally assembled with the main body 12 does not stand as an obstacle at all when the prepared article C is taken in and out or used.

Figure 16:
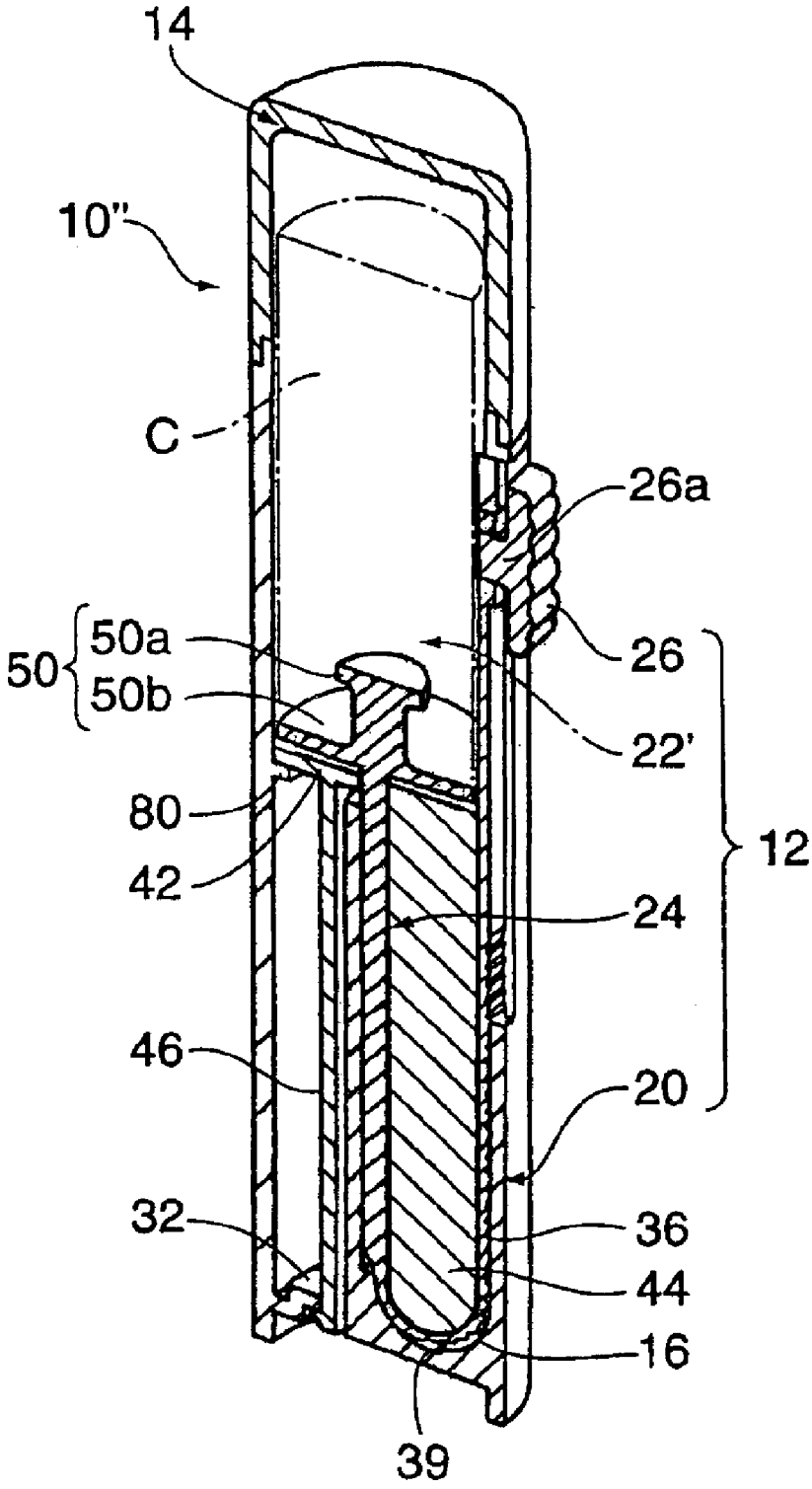
FIG. 16 is a vertical sectional view of another stick-shaped prepared article container provided with a modified internal frame member.

FIG. 16 shows a construction of a modified inner frame member 22'. The modified inner frame member 22' is identical to the previously-mentioned inner frame member 22 in the respect of construction except for the following points. Accordingly, identical elements or parts are given like reference numerals to omit detailed description of them.

The inner frame member 22' is not formed with the cylindrical wall defining the hollow support section of the inner frame member 22. The inner frame member 22' includes a partition wall 42, a guiding projection 44 extending from the underside of the partition wall 42, and a locking piece 46. A holder 50 holding a prepared article C is supported on the partition wall 42. Thus, the partition wall 42 serves as a support section.

The partition wall 42 of the inner frame member 22' is placed on a support rib 80 formed at a specified portion of an inner surface of a tubular housing 20. In this way, the inner frame member 22' is kept from moving downward. Also, the inner frame member 22' is prevented from moving upward by an engagement of a hook 46*a* at a leading end of a locking piece 46 of the inner frame member 22' with a locking hole 32*a* formed in a bottom portion 32 of the housing 20.

The inner frame member 22' is more easily insertable into the housing 20 and can accommodate a larger volume of prepared article because of not having such a cylindrical wall to define a hollow support space as that in the foregoing inner frame member 22.

The containers 10, 10' described above are merely embodiments of the present invention, and the specific constructions thereof can be suitably changed without departing from the spirit and scope of the present invention. Specifically, the present invention may take the following constructions.

Figure 14:
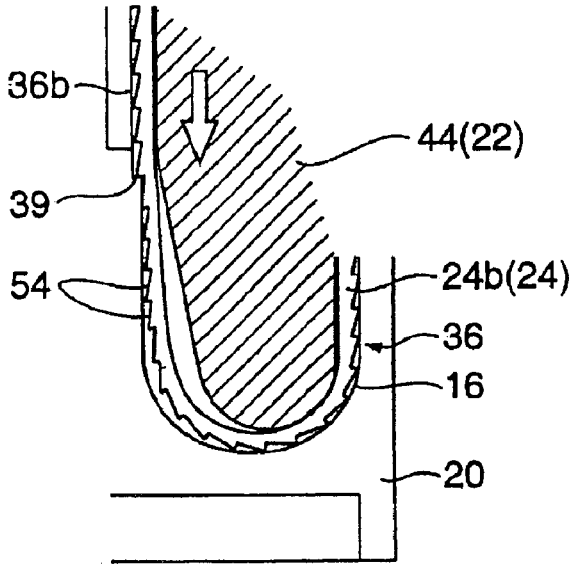
FIG. 14 is a diagram showing another exemplary relationship between the engaging teeth of the operative member and the claw portion (while the prepared article is being pushed out)
Figure 15:
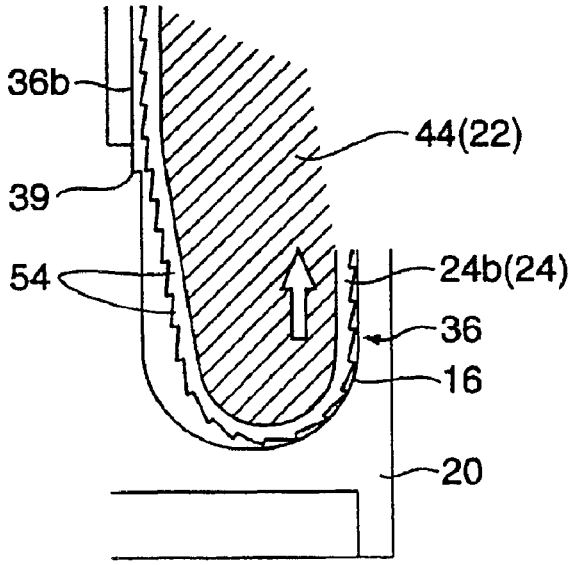
FIG. 15 is a diagram showing still another exemplary relationship between the engaging tooth of the operative member and the claw portion (while the prepared article is being accommodated.

(1) A mechanism for pushing the prepared article C back in the containers 10, 10' may take a construction as shown in FIG. 14. Specifically, the claw portion 39 is provided not at the bottom surface of the recess 36 and, instead, provided on the guide surface (part of the opposite wall 36*b*) located above this bottom surface, and the clearance is widened at a portion of the guiding path 16 extending from the turned portion of the operative member 24 to the claw portion 39, i.e., a displacement caused by the deflection of the belt portion 24*b* is permitted to make the claw portion 39 and the engaging teeth 54 engageable with and disengageable from each other. By this construction as well, when a force to push the prepared article C back acts as shown by an arrow in FIG. 14, the belt portion 24*b* is deflected toward the opposite wall 36*b* to engage the engaging tooth 54 with the claw portion 39, whereby the movement of the operative member 24 in the accommodating direction is hindered to prevent the prepared article C from being pushed back into the main body 12. On the other hand, when a tensile load is exerted on the operative member 24 by operating the operating knob 26 to accommodate the prepared article C into the main body 12, the belt portion 24*b* is moved toward the guiding projection 44 to disengage the engaging tooth 54 from the claw portion 39 as shown in FIG. 15, whereby the movement of the operative member 24 in the accommodating direction is permitted to accommodate the prepared article C into the main body 12. It should be noted that a specific construction including the position of the claw portion 39 in the guiding path 16 and the clearance of the guiding path 16 is not limited to the construction of this embodiment. In other words, any construction will do provided that the prepared article C can be prevented from being pushed back while being used by securely engaging the engaging tooth with the claw portion 39.

(2) In order to simplify the construction, the guide groove 38 of the housing 20, the elongated projections 52*a*, 52*b* and the like of the operative member 24 or the recess 36 (opposite wall 36*b*, side walls 36*c*) of the housing 20 may be omitted. In the case of omitting the recess 36, it is necessary to use the operative member 24 having a relatively high rigidity since the operative member 24 is thought to be deflected upon action of a compression load thereon to hinder the operation of pushing the prepared article C out when the operating knob 26 is operated to push the prepared article C out.

(3) In the foregoing embodiments, an assembly is formed by inserting the operative member 24 into the inner frame member 22 and folding it in U-shape and is assembled with the housing 20 by being inserted thereinto as shown in FIG. 6B. However, a divided housing which is radially divided into two pieces may be used, the above assembly may be incorporated into one of the divided piece and then the other divided piece may be joined with the one divided piece. In such a case as well, the assembly in which the operative member 24 is folded in U-shape beforehand along the guide projection 44 forming the guiding path 16 is assembled with the divided piece. Thus, unlike the prior art, a cumbersome operation of fitting the operative member along the guide grooves formed in the respective divided pieces is not necessary. Therefore, as compared to conventional containers of this type, the operative member and the like can be more easily incorporated into the container.

(4) Concerning the detailed construction, it is not necessary, for example, to integrally form the operative member 24 and the holder 50. The operative member 24 and the holder 50 separately formed may be joined together. The specific shape of the holder 50 is not limited to the double-disk structure of the foregoing embodiments, either. An optimal shape conforming to the prepared article C such as a bucket-shape, a bar-shape or a disk-shape may be suitably selected. In the foregoing embodiments, the partition wall 42 functions to retain the holder 50 as shown, for example, in FIG. 6B, thereby preventing the holder 50 from coming (coming down in FIG. 6B) out of the support section of the inner frame member 22. For example, a special retainer may be provided if there is a possibility of the holder 50 coming out of the support section of the inner frame member 22 due to a relationship between the holder 50 and the through hole 42*a*. Of course, there is no problem in functions even if the retainer is not provided. However, operability in assembling the container 10, 10' is better if the operative member 24 can be folded with the holder 50 held in abutment against the partition wall 42 by pulling the operative member 24 inserted into the inner frame member 22 and the inner frame member 22 can be inserted into the housing 20 while being held together with the knob mounting portion 56 of the operative member 24 in this state. In this respect, it is preferable to provide the retainer to prevent the holder 50 from coming out of the support section of the inner frame member 22.

(5) As a mechanism for fixing the inner frame member 22 to the housing 20, instead of providing the locking piece 46 and the like, a hook may be provided near the lower side of the jaw portion 41 on the outer circumferential surface of the inner frame member 22 and an engaging portion corresponding to this hook may be provided on the inner circumferential surface of the housing 20, so that the hook and the engaging portion are engaged with each other as the inner frame member 22 is inserted in the housing 20. Alternatively, a projection may be formed on the outer circumferential surface of the inner frame member 22 and an L-shaped guide groove comprised of a vertical groove section extending straight down from the upper end of the housing 20 and a lock groove section circumferentially extending at the bottom end of the vertical groove section may be formed in the inner circumferential surface of the housing 20. The housing 20 and the inner frame member 22 may be fixed to each other by relatively rotating the inner frame member 22 and the housing 20 to fit the projection into the lock groove section after the inner frame member 22 is inserted into the housing 20 while guiding the projection along the vertical groove. In other words, the fixing mechanism may take any construction provided that the inner frame member 22 and the housing 20 can be satisfactorily and easily fixed. However, if the jaw portion 41 is engaged with the edge of the leading-end opening of the housing 20 and the locking piece 46 provided on the inner frame member 22 is engaged with the bottom portion 32 as in the container 10, the inner frame member 22 can be quite easily fixed to the housing 20 only by inserting the inner frame member 22 into the housing 20 in assembling the container 10 and the inner frame member 22 can remain fixed while a tensile stress is acting in longitudinal direction after being fixed. Thus, there is an advantage that the inner frame member 22 can be more stably fixed.

(6) In the foregoing embodiment, the bar-shaped prepared article container for containing the bar-shaped prepared article C, for example, represented by a lipstick, a medical lip balm and a paste is described as the inventive container provided with the operating knob. However, the invention is also applicable to containers for containing a cosmetic brush, a seal, a food or something other than the prepared articles. In such a case, the holder 50 may take an optimal shape to hold an article to be contained.

As described above, the novel container is provided with the tubular housing having the opening, and the inner frame member which is an element separate from the housing, placed in the housing and formed with the support section for supporting the article and the guiding projection. The container is also provided with the operative member folded along and movable along the guiding projection. The holder located in the support section for holding the article is provided on one end of the operative member, whereas the operating knob exposed to the outside of the housing is provided at the other end thereof. The holder is made movable along the longitudinal direction of the housing by moving the operating knob along this direction.

With this construction, since the inner frame member separate from the housing is provided with the guiding projection for guiding the operative member, the inner frame member can be incorporated into the housing with the holder accommodated in the inner frame member and the operative member guided along the guiding projection at the time of assembling the container. Thus, time and labor required to assemble the container are saved to improve an assembling operability as compared to conventional containers of this type which require the holder to be incorporated into the housing while the operative member is fitted into the guide groove.

In this container, the inner frame member and the holder are incorporated into the housing preferably by inserting the inner frame member into the housing through the leading-end opening together with the holder with the holder accommodated in the inner frame member and the operative member folded in U-shape along the guiding projection.

With this construction, in assembling the container, the holder and the like are incorporated into the housing by folding the operative member in U-shape along the guiding projection of the inner frame member and inserting the inner frame member and the like into the housing through the leading-end opening while the leading end of the operative member and the inner frame member are held together. Thus, the operative member can be securely prevented from experiencing a springback, and the operative member can be easily incorporated into the housing while being folded in U-shape.

In such a case, it is more preferable to form the tubular guiding recess inside the housing which recess is open toward the leading-end opening of the housing and guides the guiding projection and the operative member as the inner frame member is inserted into the housing.

With this construction, since the operative member is fixedly held to a certain degree, an unnecessary deflection of the operative member due to a compression load when the operating knob is operated at the time of using the article can be prevented. Thus, the article can be more satisfactorily taken in and out. Further, relative displacements of the guiding projection and the operative member during the insertion of the inner frame member and the like into the housing can be effectively prevented when the container is to be assembled. Therefore, assembling operability can be further improved.

In this container, it is preferable to provide the fixing mechanism for automatically fixing the housing and the inner frame member so as not to disengage from each other when the inner frame member is inserted up to the specified insertion position in the housing.

With this construction, since the inner frame member and the housing are automatically fixed only by inserting the inner frame member and the like into the housing, assembling operability can be even further improved by obviating the need for a special operation of fixing the inner frame member.

The fixing mechanism may, for example, take such a construction that the jaw portion is provided at the leading end of the inner frame member, the locking piece extending in longitudinal direction is provided on the partition wall, and the locking piece is engaged with the engaging portion provided at the bottom of the housing when the inner frame member is inserted into the housing up to the position where the jaw portion comes into contact with the edge of the leading-end opening of the housing.

With this construction, since a tensile stress acts on the inner frame member in longitudinal direction when the inner frame member is fixed to the housing, the inner frame member can be more stably fixed to the housing.

The inner frame member is preferably provided with the retainer engageable with the holder to prevent the holder from coming out.

With this construction, operability can be further improved since the holder is prevented from coming out of the inner frame member during the assembling of the container.

Further preferably, the guiding path for guiding the operative member while folding it in U-shape may be formed by the housing and the guiding projection of the inner frame member; the step-shaped claw portion may be provided on the guide surface of the housing defining the guiding path and the engaging teeth engageable with the claw portion are formed on the surface of the operative member facing the guide surface of the housing; the claw portion and the engaging teeth are so formed as to hinder the movement of the operative member in the accommodating direction of the article when being engaged with each other; the clearance of the guiding path is set such that the operative member comes into contact with the guide surface of the housing to engage the engaging tooth and the claw portion when a load acts on the article in the accommodating direction with the article pushed out toward the leading end of the container, whereas the operative member departs from the guide surface of the housing to disengage the engaging tooth and the claw portion when a tensile load is exerted on the operative member by operating the operating knob to accommodate the article.

With this construction, the article can be smoothly pushed out without the engaging tooth and the claw portion being engaged as the operating knob is operated. Further, at the time of using the article, the engaging tooth and the claw portion are engaged to hinder the movement of the operative member (movement of the article in the accommodating direction). As a result, the article is prevented from being pushed back. At this time, the article is prevented from being pushed back regardless of the pushed-out state (position) of the article by the engagement of the engaging tooth and the claw portion at a desired position according to an pushed-out amount of the article. When the operating knob is operated to accommodate the article, the operative member departs from the outer guide surface, whereby the engaging tooth and the claw portion are disengaged and the article is smoothly accommodated as the operating knob is operated.

In this case, the engaging teeth of the operative member and the claw portion can be satisfactorily engaged with and disengaged from each other, for example, if the clearance of the guiding path is set such that the clearance at the turned portion and the clearance at the portion of the guiding path opposite from the holder side with respect to the turned portion are set larger than the clearance at the other portions of the guiding path in the case that the claw portion is provided at a position corresponding to the turned portion of the operative member, whereas the clearance at a portion of the guiding path extending near the claw portion to the turned portion is larger than the clearance at the other portions of the guiding path in the case that the claw portion is provided at a position more toward the holder than the turned portion of the operative member.

The guiding path is preferably formed to have a U-shaped cross section.

Such a guiding path enables the operative member to be smoothly guided and is useful in engaging and disengaging the engaging teeth of the operative member and the claw portion with and from each other as above.

In this container, the lid is preferably coupled to the operating knob so as to open and close the leading-end opening as the operating knob is operated.

With this construction, the operation of taking the article in and out including the opening and closing of the lid can be performed only by operating the operating knob. Thus, the operation of taking the article in and out can be completely performed by one hand and a loss of the lid can be prevented.

In this construction, it is preferable to directly couple the lid to the operating knob, to make the lid movable toward the lateral side of the main body while opening the leading-end opening when the operating knob is moved to push the article out, and to mount the operating knob on the operative member so that the article is pushed out as or after the lid is moved toward the lateral side of the main body.

With this construction, the lid is unlikely to stand as an obstacle when the article is taken in and out or used.

In the case of this construction, the lid may be rotatably coupled to the operating knob and the cam portion for closing the lid may be provided at the leading end of the main body, so that part of the lid comes into contact with the cam portion and the lid is rotated with respect to the operating knob to close the leading-end opening when the operating knob is moved to accommodate the article in a state where the leading-end opening is opened.

With the above construction, the closing of the leading-end opening by the lid as the operating knob is operated can be realized by a fairly simple mechanism.

This application is based on patent application Nos. 2001-189968 and 2001-189969 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A container, comprising:

a tubular housing having an opening;

an inner frame member separate from the housing, placed in the housing, and formed with a partition wall and a guiding projection, the partition wall having a through hole;

an operative member folded along and movable along the guiding projection;

a holder provided at one end of the operative member, the holder having a bottom support section for supporting a bottom of an article, the one end of the operative member connected with an underside of the holder, the bottom support section being maintained in position by the partition wall and the operative member includes a portion disposed in the through hole of the partition wall; and an operating knob provided at the other end of the operative member and exposed to the outside of the housing, whereby the holder is moved in a longitudinal direction of the housing by moving the operating knob in the longitudinal direction of the housing.

2. A container according to claim 1, wherein the inner frame member is insertable into the housing through the opening, with the bottom support section of the holder located on the partition wall and the operative member mounted along the guiding projection.

3. A container according to claim 2, wherein the guiding projection has a U-shaped portion, and the housing is formed with a guiding recess for receiving the guiding projection and defining a guiding path having a specified space in cooperation with the guiding projection to guide the operative member.

4. A container according to claim 3, further comprising a fixing mechanism for fixing the inner frame member to the housing.

5. A container according to claim 3, wherein a step-shaped claw portion is formed on a guiding surface of the guiding recess in the guiding path, an engaging tooth engageable with the claw portion is formed at a specified position of the operative member, and a movement of the operative member in an accommodating direction of the article is hindered when the claw portion is engaged with the engaging tooth.

6. A container according to claim 1, wherein the operative member has a guiding portion extending from the bottom support section in the longitudinal direction of the housing.

7. A container according to claim 6, wherein the through hole of the partition wall is formed at a center thereof so as to guide the operative member.

8. A container according to claim 7, wherein the inner fame member has a hollow support section for supporting the article, the partition wall is formed at a bottom of the hollow support section.

9. A container comprising:

a tubular housing having an opening;

an inner frame member separate from the housing, placed in the housing, and formed with a support section for supporting an article to be contained and a guiding projection;

an operative member folded along and movable along the guiding projection;

a holder provided at one end of the operative member and located in the support section for holding the article; and an operating knob provided at the other end of the operative member and exposed to the outside of the housing, whereby the holder is moved in a longitudinal direction of the housing by moving the operating knob in the longitudinal direction of the housing, and wherein the inner fame member is insertable into the housing through the opening with the holder located in the support section and the operative member mounted along the guiding projection, wherein the guiding projection has a U-shaped portion, and the housing is formed with a guiding recess for receiving the guiding projection and defining a guiding path having a specified space in cooperation with the guiding projection to guide the operative member, wherein a step-shaped claw portion is formed on a guiding surface of the guiding recess in the guiding path, an engaging tooth engageable with the claw portion is formed at a specified position of the operative member, and a movement of the operative member in an accommodating direction of the article is hindered when the claw portion is engaged with the engaging tooth, wherein a clearance of the guiding path is set such that the operative member comes into contact with a guiding surface of the housing to engage the engaging tooth and the claw portion with each other when a load acts on the article in the accommodating direction with the article pushed out toward the leading end of the container, whereas the operative member departs from the guiding surface of the housing to disengage the engaging tooth and the claw portion from each other when a tensile load is exerted on the operative member by operating the operating knob to accommodate the article.

10. A container according to claim 9, wherein the claw portion is provided at a position corresponding to a turned portion of the operative member, and the clearance of the guiding path corresponding to the turned portion and that of a portion of the guiding path opposite from the holder with respect to the turned portion are set larger than the clearance at other portions of the guiding path.

11. A container according to claim 9, wherein the claw portion is provided at a position more toward the holder than the turned portion of the operative member, and the clearance of a portion of the guiding path extending near the claw portion to the turned portion is set larger than the clearance at other portions of the guiding path.

12. A container according to claim 9, wherein the guiding path is formed to have a U-shaped cross section.

13. A container according to claim 9, further comprising a lid for closing the opening at the leading end of the housing, wherein the lid is coupled to the operating knob so that the opening can be opened and closed as the operating knob is operated.

14. A container according to claim 13, wherein the lid is directly coupled to the operating knob, and the operating knob is mounted on the operative member such that the lid is moved toward a lateral side of a main body of the housing while opening the opening at the leading end of the housing when the operating knob is moved to push the article out, and the article is pushed out as or after the lid is moved to the lateral side of the main body.

15. A container according to claim 14, wherein the lid is rotatably coupled to the operating knob, a cam portion for closing the lid is provided at the leading end of the main body, and part of the lid comes into contact with the cam portion to rotate the lid with respect to the operating knob, thereby closing the opening at the leading end of the housing, when the operating knob is moved to accommodate the article in a state where the opening is opened.

16. A container comprising:

a tubular housing having an opening;

an inner frame member separate from the housing, placed in the housing, and formed with a support section for supporting an article to be contained and a guiding projection;

an operative member folded along and movable along the guiding projection;

a holder provided at one end of the operative member and located in the support section for holding the article;

an operating knob provided at the other end of the operative member and exposed to the outside of the housing; and a fixing mechanism for fixing the inner frame member to the housing, whereby the holder is moved in a longitudinal direction of the housing by moving the operating knob in the longitudinal direction of the housing, and wherein the inner frame member is insertable into the housing through the opening with the holder located in the support section and the operative member mounted along the guiding projection, wherein the guiding projection has a U-shaped portion, and the housing is formed with a guiding recess for receiving the guiding projection and defining a guiding path having a specified space in cooperation with the guiding projection to guide the operative member, wherein the fixing mechanism includes a jaw portion which is formed at an upper part of the inner frame member and can be held in contact with the upper edge of the housing, and a locking piece formed at a bottom part of the inner frame member and engageable with an engaging portion provided at a specified position of a bottom portion of the housing.

17. A container according to claim 16, wherein the inner frame member includes a retainer which prevents the holder from coming out of the support section.

18. A container according to claim 16, further comprising a lid for opening and closing the opening of the housing, wherein the lid is coupled to the operating knob so that the opening can be opened and closed as the operating knob is operated.

19. A container according to claim 18, wherein the lid is directly coupled to the operating knob, and the operating knob is mounted on the operative member such that the lid is moved toward a lateral side of a main body of the housing while opening the opening when the operating knob is moved to push the article out, and the article is pushed out as or after the lid is moved to the lateral side of the main body.

20. A container according to claim 19, wherein the lid is rotatably coupled to the operating knob, a cam portion is provided at the leading end of the main body, and part of the lid comes into contact with the cam portion to rotate the lid with respect to the operating knob, thereby closing the opening, when the operating knob is moved to accommodate the article.

21. A container, comprising:

a tubular housing having an opening and a guiding recess;

a U-shaped guide section provided in the housing, the U-shaped guide section extending in the guiding recess to define a guiding path having a specified space;

an operative member folded along and movable along the U-shaped guide section;

a holder provided at one end of the operative member and located in the housing for holding an article; and an operating knob provided at the other end of the operative member and exposed to the outside of the housing, whereby the holder holding the article is moved in a longitudinal direction of the housing by moving the operating knob in the longitudinal direction of the housing, and wherein a step-shaped claw portion is formed on a guiding surface of the guiding recess in the guiding path, an engaging tooth engageable with the claw portion is formed at a specified position of the operative member, and a movement of the operative member in an accommodating direction of the article is hindered when the claw portion is engaged with the engaging tooth, wherein the space of the guiding path is set such that the operative member comes into contact with the guiding surface to engage the engaging tooth and the claw portion with each other when a load acts on the article in the accommodating direction with the article pushed out toward the leading end of the container, whereas the operative member departs from the guiding surface to disengage the engaging tooth and the claw portion from each other when a tensile load is exerted on the operative member by operating the operating knob to accommodate the article.

22. A container according to claim 21, further comprising an inner frame member separately placed in the housing, wherein the U-shaped guide section is integrally formed with the inner frame member.

23. A container according to claim 22, further comprising a fixing mechanism for fixing the inner frame member to the housing.

24. A container according to claim 21, further comprising a lid for closing the opening at the leading end of the housing, wherein the lid is coupled to the operating knob so that the opening can be opened and closed as the operating knob is operated.

* * * * *